United States Patent [19]

Chandroga

[11] 4,019,530

[45] Apr. 26, 1977

[54] CHEMICAL DILUTING SYSTEM

[75] Inventor: Issabhai I. Chandroga, Oshawa, Canada

[73] Assignee: The Raymond Lee Organization, Inc., New York, N.Y. ; a part interest

[22] Filed: Feb. 17, 1976

[21] Appl. No.: 658,373

[52] U.S. Cl. ..... 137/334; 137/255; 137/551; 23/267 R

[51] Int. Cl.[2] ..... B01F 1/00

[58] Field of Search ..... 137/334, 335, 336, 340, 137/571, 572, 551, 255, 263, 268; 23/267 R

[56] References Cited

UNITED STATES PATENTS

| | | | |
|---|---|---|---|
| 1,404,972 | 1/1922 | Kells | 137/335 X |
| 2,326,475 | 8/1943 | Matthews | 137/551 X |
| 2,607,718 | 8/1952 | Suthard | 23/267 R |
| 3,403,980 | 10/1968 | Litterio | 23/267 R |
| 3,607,105 | 9/1971 | Reid et al. | 23/267 R |

*Primary Examiner*—Alan Cohan
*Assistant Examiner*—Gerald A. Michalsky

[57] ABSTRACT

A pipe system connects a first supply tank to a flask for dissolving solids, connects the flask to a mixing tank, connects the first supply tank to the flask and to the mixing tank, connects a second supply tank to the mixing tank and connects the mixing tank to an outlet. Valves in the pipe system selectively control the connection of the first supply tank to the flask and to the mixing tank and of the mixing tank to the flask and to the first supply tank. Pumps in the pipe system pump liquids through the pipe system.

4 Claims, 1 Drawing Figure

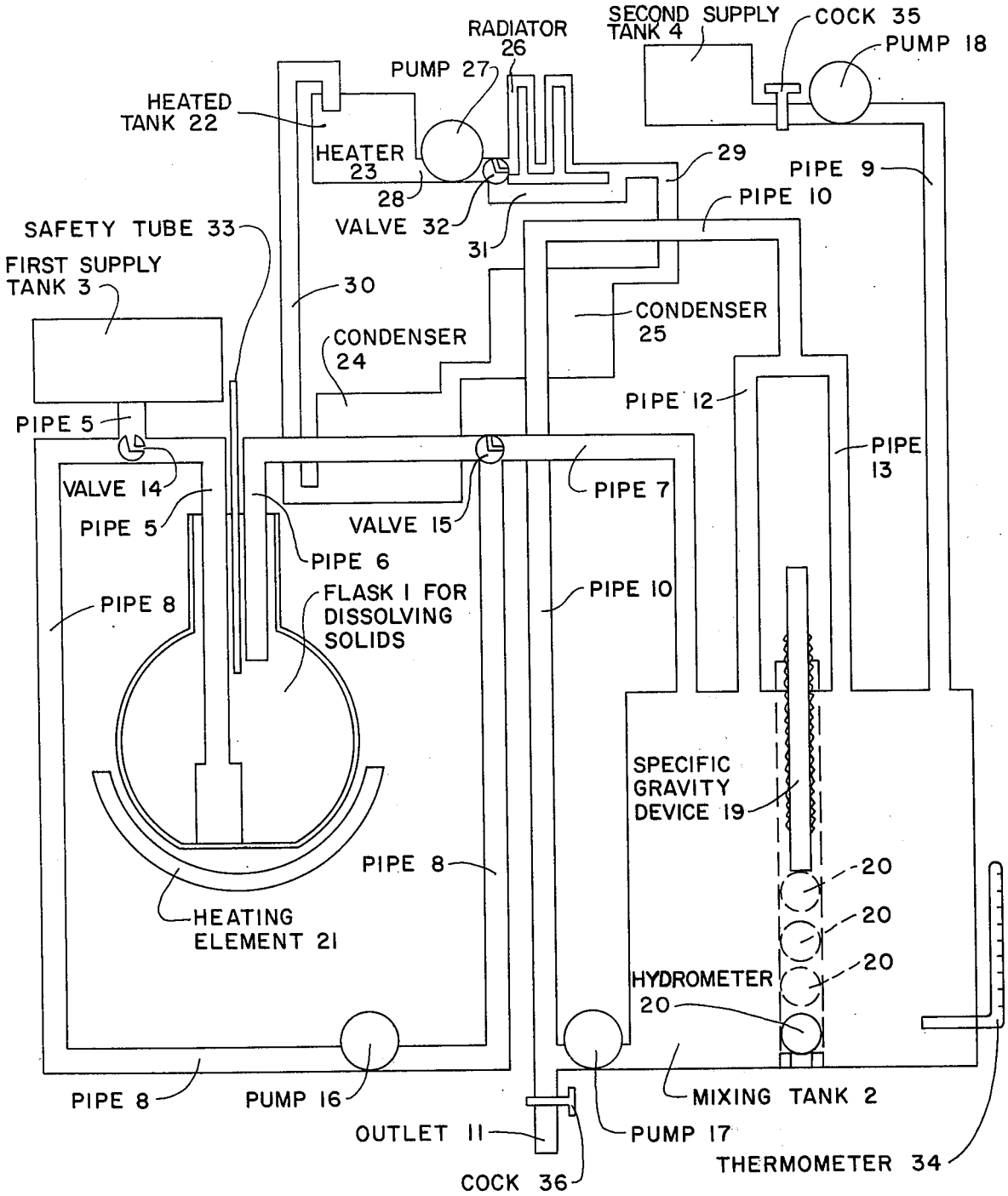
RADIATOR 26
SECOND SUPPLY TANK 4
COCK 35
PUMP 18
PUMP 27
HEATED TANK 22
HEATER 23
28
VALVE 32
31
29
PIPE 9
PIPE 10
SAFETY TUBE 33
FIRST SUPPLY TANK 3
30
CONDENSER 24
CONDENSER 25
PIPE 12
PIPE 13
PIPE 5
VALVE 14
PIPE 5
VALVE 15
PIPE 7
PIPE 6
PIPE 8
FLASK I FOR DISSOLVING SOLIDS
PIPE 10
SPECIFIC GRAVITY DEVICE 19
PIPE 8
HEATING ELEMENT 21
20
20
20
HYDROMETER 20
PIPE 8
PUMP 16
MIXING TANK 2
OUTLET 11
PUMP 17
THERMOMETER 34
COCK 36

CHEMICAL DILUTING SYSTEM

DESCRIPTION OF THE INVENTION

The present invention relates to a chemical diluting system.

Objects of the invention are to provide a chemical diluting system of simple structure, which is inexpensive in manufacture, assembled with facility and convenience, and functions efficiently, effectively and reliably to dilute chemicals.

In order that the invention may be readily carried into effect, it will now be described with reference to the accompanying drawing, wherein the single FIGURE is a schematic diagram of an embodiment of the chemical diluting system of the invention.

The chemical diluting system of the invention comprises a flask 1 for dissolving solids, a mixing tank 2, a first supply tank 3, and a second supply tank 4.

A pipe system includes a pipe 5 connecting the first tank 3 to the flask 1, second and third pipes 6 and 7 connecting the flask to the mixing tank 2, a fourth pipe 8 connecting the first supply tank to the flask and to the mixing tank via the third pipe 7, a fifth pipe 9 connecting the second supply tank 4 to the mixing tank, and a sixth pipe 10 connecting the mixing tank to an outlet 11 via branch pipes 12 and 13.

A pair of valves 14 and 15 at the juncture of the pipes 5 and 8, and at the juncture of the pipes 6, 7, and 8, respectively, selectively control the connection of the first supply tank 3 to the flask 1 and to the mixing tank 2, and the connection of said mixing tank to the flask and to the first supply tank.

Pumps 16, 17 and 18 in the pipe 8, adjacent the mixing tank 2, and in the pipe 9, respectively, pump liquids through the pipes.

The pipe 6 recirculates a solution from the flask 1 back to said flask via the pipe 5, the valve 14, the pipe 8, the pump 16, the valve 15 and the pipe 6. Any solvent or solution from the first supply tank 3 or from the flask 1 passes through the pump 16 and is directed to the mixing tank 2 via the valve 15.

The pipe 10 is connected to the bottom of the mixing tank 2 and recirculates liquid for proper mixing.

The valve 14 directs liquid from the first supply tank 3 to the pump 16 via the pipe 8 and also directs liquid to the flask 1 via the pipe 5 and circulates liquid by connecting the pipes 5 and 8 to each other. The valve 15 connects the pipes 8 and 7 to supply liquid from the first supply tank 3 or the flask 1 to the mixing tank 2. It is used to circulate liquid from the flask 1 back to said flask, as hereinbefore described.

A specific gravity device 19 including a hydrometer 20, is provided in the mixing tank. The specific gravity device 19 has an upper part comprising concentric cylindrical members having worm gears on the outer surface of the inner cylinder and on the inner surface of the outer cylinder. One of the cylinders is movable up or down, in axial directions, dependent upon the volume of the diluted solution required, and has electrical connections thereon. The bottom of the other of the cylinders has similar electrical connections but is fixed in position. The hydrometer 20 comprises a platinum coated glass bulb of an exact predetermined specific gravity and occupies different positions in accordance with the density of the liquid, as indicated by the broken lines in the FIGURE. A set of different hydrometers are provided for different specific gravities and different dilutions of the liquid.

The flask 1 is heated by any suitable means such as, for example, a heating element 21.

A heated tank 22 is heated by any suitable means, such as, for example, a heater 23. A pair of condensers 24 and 25 are provided. The condenser 24 surrounds the pipe 6 connecting the flask 1 to the mixing tank 2. The condenser 25 surrounds the pipe 10 connecting the mixing tank 2 to the outlet 11. A radiator 26 and a pump 27 are provided.

Additional pipes 28, 29 and 30 connect the heated tank 22 to the radiator 26 via the pump 27 and connect said radiator to the heated tank via the pair of condensers 25 and 24. A bypass pipe 31 and a valve 32 permit the direct connection of the heated tank 22 to the condenser 25, via the pump 27, bypassing the radiator 26.

The condenser 25 regulates the temperature of the solution flowing through the pipe 10. The branch pipes 12 and 13 provide proper mixing and accurate operation of the hydrometer 20.

A safety tube 33 is provided in the flask 1 for eliminating high pressures produced during heating of a mixture.

A thermometer 34 is provided in the mixing tank 2 to indicate the temperature of the solution therein.

A cock 35 is provided in the pipe 9 for the second supply tank 4 and a cock 36 is provided in the outlet 11 of the pipe 10.

The pump 16 is a metering pump which pumps all types of chemicals and is energized via an electric circuit which permits said pump to deliver a selected exact volume of liquid from the first supply tank 3 to the mixing tank 2. After the pump 16 delivers the selected exact volume of liquid, an electric circuit is switched via the contacts of the specific gravity device 19 and the hydrometr 20, if the specific gravity of the liquid supplied by the first supply tank 3 or the flask 1 is lower than the liquid supplied by the second supply tank 4. If the specific gravity of the liquid supplied by the first supply tank 3 or the flask 1 is higher than that of the liquid supplied by the second supply tank 4, the operation is reversed, and commences at the lowermost position of the hydrometer.

The pump 18 is a metering pump and is energized by an electrical circuit with opposite electrical connections to that of the pump 16, relative to the specific gravity device. Both pumps 16 and 18 deliver a selected exact volume of liquid to the mixing tank 2 at the beginning of the operation.

While the invention has been described by means of a specific example and in a specific embodiment, I do not wish to be limited thereto, for obvious modifications will occur to those skilled in the art without departing from the spirit and scope of the invention.

I claim:

1. A chemical diluting system, comprising a heated flask for dissolving solids;

a mixing tank;

a first supply tank;

a second supply tank;

pipe means connecting the first tank to the flask, connecting the flask to the mixing tank, connecting the first supply tank to the flask and to the mixing tank, connecting the second supply tank to the mixing tank and connecting the mixing tank to an outlet;

valve means in the pipe means for selectively controlling the connection of the first supply tank to the flask and to the mixing tank and of the mixing tank to the flask and to the first supply tank; and pump means in the pipe means for pumping liquids through the pipe means.

2. A chemical diluting system as claimed in claim 1, further comprising specific gravity means including a hydrometer in the mixing tank.

3. A chemical diluting system, comprising a flask for dissolving solids;

a mixing tank;

a first supply tank;

a second supply tank;

pipe means connecting the first tank to the flask, connecting the flask to the mixing tank, connecting the first supply tank to the flask and to the mixing tank, connecting the second supply tank to the mixing tank and connecting the mixing tank to an outlet;

valve means in the pipe means for selectively controlling the connection of the first supply tank to the flask and to the mixing tank and of the mixing tank to the flask and to the first supply tank;

pump means in the pipe means for pumping liquids through the pipe means;

a heated tank;

a pair of condensers, one of said condensers surrounding the pipe means connecting the flask to the mixing tank;

radiator means;

additional pump means; and additional pipe means connecting the heated tank to the radiator means via the additional pump means and connecting the radiator means to the heated tank via the pair of condensers.

4. A chemical diluting system as claimed in claim 3, wherein the other of the condensers surrounds the pipe means connecting the mixing tank to the outlet.

* * * * *